US010598429B2

(12) United States Patent
Kaymak et al.

(10) Patent No.: US 10,598,429 B2
(45) Date of Patent: Mar. 24, 2020

(54) COOLING DEVICE COMPRISING OF A KNOB PROVIDING THE ADJUSTMENT OF THE COMPARTMENT TEMPERATURE

(71) Applicant: ARCELIK ANONIM SIRKETI, Istanbul (TR)

(72) Inventors: Mehmet Ercan Kaymak, Istanbul (TR); Kadir Ridvan Celik, Istanbul (TR); Faik Emre Ozyuksel, Istanbul (TR); Yuksel Atilla, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 276 days.

(21) Appl. No.: 14/652,374

(22) PCT Filed: Nov. 22, 2013

(86) PCT No.: PCT/EP2013/074429
§ 371 (c)(1),
(2) Date: Jun. 15, 2015

(87) PCT Pub. No.: WO2014/090540
PCT Pub. Date: Jun. 19, 2014

(65) Prior Publication Data

US 2015/0330704 A1 Nov. 19, 2015

(30) Foreign Application Priority Data

Dec. 14, 2012 (TR) ..... a 2012/14709

(51) Int. Cl.
*F25D 29/00* (2006.01)
*F25D 27/00* (2006.01)

(52) U.S. Cl.
CPC ..... *F25D 29/005* (2013.01); *F25D 27/005* (2013.01)

(58) Field of Classification Search
CPC ..... F25D 27/005; F25D 29/005; G05G 1/087; H01H 19/025; H01H 19/14;
(Continued)

(56) References Cited

U.S. PATENT DOCUMENTS 2,129,474 A * 9/1938 Money ..... F25D 29/00 116/307
2,253,162 A * 8/1941 Ayers ..... F25D 21/002 337/103

(Continued)

FOREIGN PATENT DOCUMENTS

DE 1248074 B 8/1967
DE 8803427 U1 5/1988

(Continued)

OTHER PUBLICATIONS

International Search Report of WO 2014/090540A1.

*Primary Examiner* — Elizabeth J Martin
*Assistant Examiner* — Melodee Jefferson
(74) *Attorney, Agent, or Firm* — Kilpatrick Townsend & Stockton LLP

(57) ABSTRACT

The present invention relates to a cooling device (1) comprising at least one compartment (2) wherein foodstuffs desired to be cooled are placed, at least one door (3) providing access into the compartment (2) and a push-release type knob (4) that is situated on the surface, facing the inner volume of the compartment (2), of one of the compartment (2) walls, that enables the compartment (2) temperature (T) to be changed by the user and that has an active position wherein the temperature adjustment is performed by rotating the knob (4) and a passive position to which the knob (4) is changed by being pushed when the desired temperature value is set.

10 Claims, 4 Drawing Sheets

Figure 1:
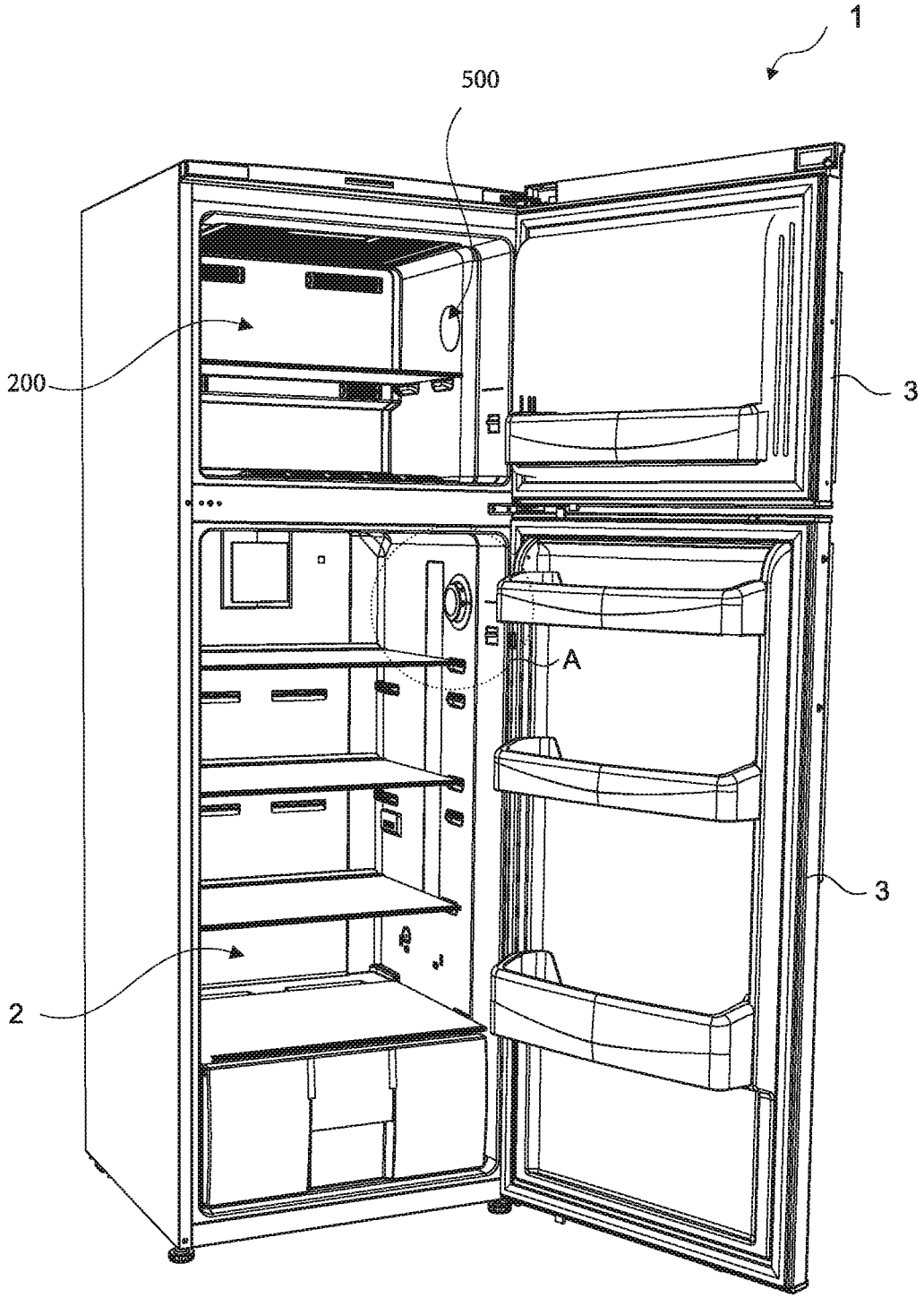

(58) Field of Classification Search
CPC ..... H01H 2003/085; H01H 2219/0622; H01H 3/08; H01H 9/182
USPC ..... 62/129
See application file for complete search history.

(56) References Cited

U.S. PATENT DOCUMENTS

| | | | | | |
|---|---|---|---|---|---|
| 2,341,924 | A * | 2/1944 | Kruck | F25D 29/005 | 116/320 |
| 3,724,281 | A * | 4/1973 | Dorchester | F16H 15/52 | 475/158 |
| 4,014,178 | A * | 3/1977 | Kells | F25D 29/005 | 62/125 |
| 4,262,490 | A * | 4/1981 | McKinnon | F25D 29/005 | 337/380 |
| 5,060,486 | A * | 10/1991 | Linstromberg | F25D 29/00 | 200/43.16 |
| 5,819,597 | A * | 10/1998 | Sato | B60H 1/0065 | 116/315 |
| 6,060,987 | A * | 5/2000 | Marlia | F25D 29/008 | 340/529 |
| 6,101,819 | A * | 8/2000 | Onaka | F25D 29/005 | 337/327 |
| 6,348,772 | B1 | 2/2002 | May | | |
| 6,610,947 | B2 * | 8/2003 | Campana | H01H 19/03 | 200/336 |
| 6,710,565 | B2 * | 3/2004 | Maeda | B60K 37/06 | 200/501 |
| 7,044,023 | B2 * | 5/2006 | Toniolo | F16K 31/535 | 122/504 |
| 7,222,879 | B2 * | 5/2007 | Ishida | B60R 21/0155 | 180/273 |
| 7,428,820 | B2 * | 9/2008 | Kim | B67D 1/0858 | 62/347 |
| 7,568,359 | B2 * | 8/2009 | Wetekamp | F25C 5/005 | 62/135 |
| 7,878,018 | B2 * | 2/2011 | Park | A23L 3/26 | 62/177 |
| 8,192,319 | B2 * | 6/2012 | Rhême et al. | H01C 10/14 | 475/196 |
| 2005/0067268 | A1 * | 3/2005 | Hurrle | H01H 9/161 | 200/314 |
| 2005/0276034 | A1 * | 12/2005 | Malpetti | F25D 27/005 | 362/89 |
| 2007/0157640 | A1 * | 7/2007 | Bolger | F25D 29/008 | 62/129 |
| 2009/0084220 | A1 * | 4/2009 | Morizono | B60H 1/0065 | 74/501.6 |
| 2011/0271896 | A1 | 11/2011 | Fuller et al. | | |
| 2012/0241654 | A1 * | 9/2012 | Clifford | F16K 31/60 | 251/96 |
| 2013/0205817 | A1 * | 8/2013 | Coulter | F25D 11/02 | 62/129 |

FOREIGN PATENT DOCUMENTS

| | | | |
|---|---|---|---|
| DE | 19503339 | A1 | 8/1995 |
| DE | 10236935 | A1 | 2/2004 |
| DE | 102004048309 | A1 | 4/2006 |
| DE | 102006059725 | A1 | 6/2008 |
| DE | 102007019517 | A1 | 10/2008 |
| DE | 102011001435 | A1 | 11/2011 |
| EP | 0276463 | A2 | 8/1988 |
| EP | 0176817 | B1 | 11/1988 |
| EP | 0892230 | A1 | 1/1999 |
| EP | 1939531 | A2 | 7/2008 |
| EP | 2251762 | A2 | 11/2010 |
| GB | 2405190 | A | 2/2005 |
| JP | 2002231101 | A | 8/2002 |
| KR | 20010059559 | A | 7/2001 |
| WO | 2011113733 | A1 | 9/2011 |

* cited by examiner

COOLING DEVICE COMPRISING OF A KNOB PROVIDING THE ADJUSTMENT OF THE COMPARTMENT TEMPERATURE

RELATED APPLICATIONS

This application is a U.S. National Phase of International Application No. PCT/EP2013/074429, filed Nov. 22, 2013, claiming priority to Turkish Patent Application No. 2012/14709, filed Dec. 14, 2012, contents of which are hereby incorporated by reference in their entirety.

The present invention relates to a cooling device comprising a knob that provides the adjustment of the compartment temperature.

In the state of the art, thermostats are placed into the compartments wherein foodstuffs to be cooled are placed in order to maintain the compartments in the desired temperature range. The thermostats control the ambient temperature by activating/deactivating the compressor and/or the fan when needed according to the ambient temperature. The thermostat adjustment is generally performed by rotating the thermostat knob situated at the inner volume of the compartment. However, the thermostat knobs occupy space at the inner volume of the compartment, causing the compartment volume, that is desired to be wide as much as possible, to narrow. Moreover, while the user is placing foodstuffs into the compartment, foodstuff storage receptacles such as container, pot, etc. may hit the thermostat knob and thus the thermostat knob may be damaged.

In the state of the art Korean Patent Document No. KR20010059559, a refrigerator is disclosed, comprising a thermostat knob that is used by rotating.

The aim of the present invention is the realization of a cooling device comprising a knob providing an efficient and long-lasting utilization.

The cooling device realized in order to attain the aim of the present invention, explicated in the first claim and the respective claims thereof comprises a knob that extends from the compartment wall of the cooling device into the compartment inner volume and that has an active position wherein the compartment temperature can be adjusted by rotating the knob and a passive position wherein the knob is brought to the same level with the compartment wall by being pushed.

In an embodiment of the present invention, the knob does not protrude from the compartment surface when in the passive position. Thus, loading/unloading can be easily performed, providing increase in customer satisfaction.

In an embodiment of the present invention, the knob is directly connected to the thermostat. Thus, the compartment inner temperature can be easily adjusted.

In an embodiment of the present invention, the cooling device comprises a housing placed into an opening arranged on a compartment, and a knob mounted into the housing. Light sources are placed at the rear side of the knob. The periphery of the knob is illuminated by means of an illumination aperture that transmits the light coming from the light source. The light sources are positioned on a carrier. The periphery of the knob is illuminated by means of the carrier and the illumination aperture.

In a derivative of this embodiment, the carrier is circular. Thus, the carrier can be easily placed into the housing.

In another embodiment of the present invention, the cooling device comprises two upright members that limit the movement of the knob while the knob is rotated right and left and a C-shaped carrier placed between the upright members. The C-shaped carrier can be easily placed between the upright members.

In an embodiment of the present invention, transparent temperature values are disposed around the knob and an indicator is disposed on the housing indicating which temperature value is activated when the user rotates the knob. In this embodiment, all temperature values are illuminated.

In a derivative of this embodiment, there is a light transmitter which transmits the light received from the light source only to the temperature value indicated by the indicator. In this embodiment, only one light source is used in order to illuminate the temperature value aligned with the indicator.

In an embodiment of the present invention, the cooling device comprises a switch that detects whether the door is open or closed, and the light source that gives light when the door is open. In this embodiment, no additional illumination element is used besides the light source in order to illuminate the inner volume of the compartment.

In an embodiment of the present invention, the light source is a LED light bulb. Consequently, energy saving is provided.

By means of the present invention the inner volume of the cooling device is efficiently used.

The model embodiments relating to a cooling device realized in order to attain the aim of the present invention are illustrated in the attached figures, where:

FIG. 1—is the schematic view of a cooling device when the knob is in the active position in an embodiment of the present invention.

Figure 2:
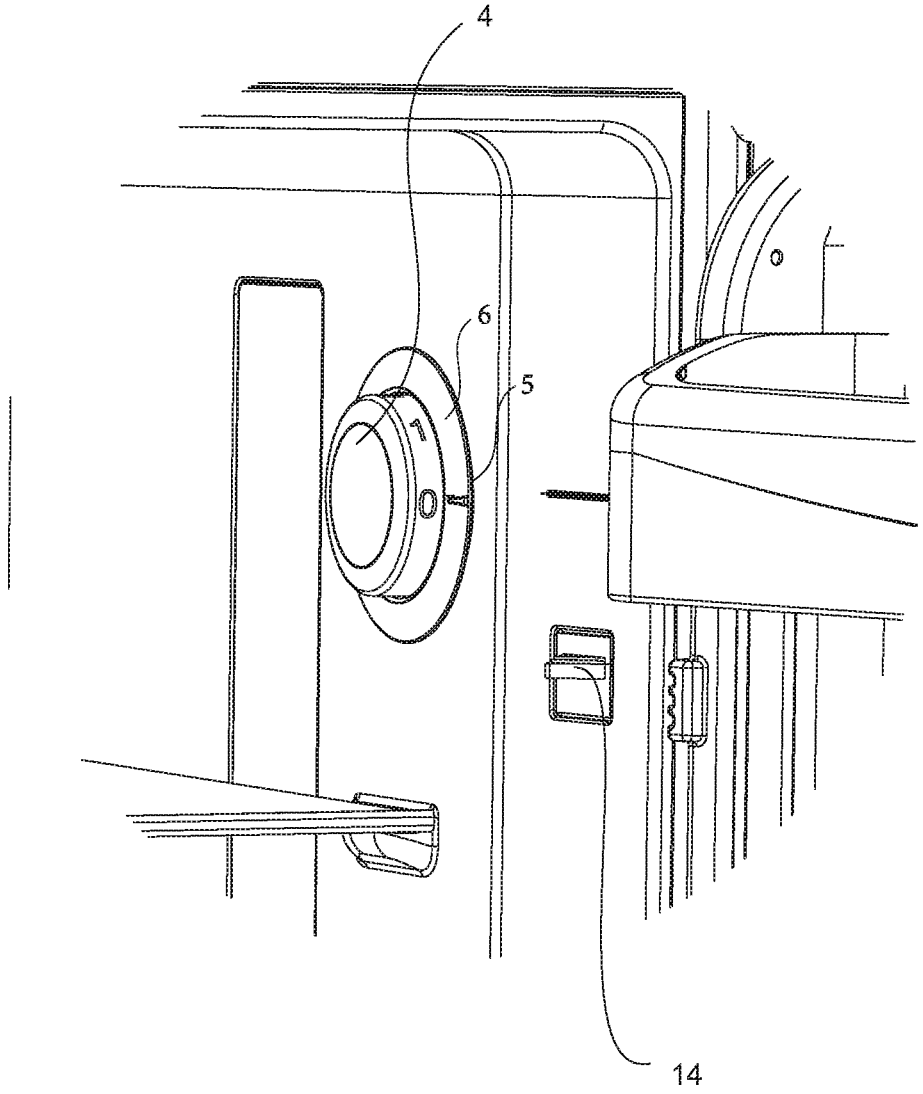

FIG. 2—is the view of detail A in FIG. 1.

Figure 3:
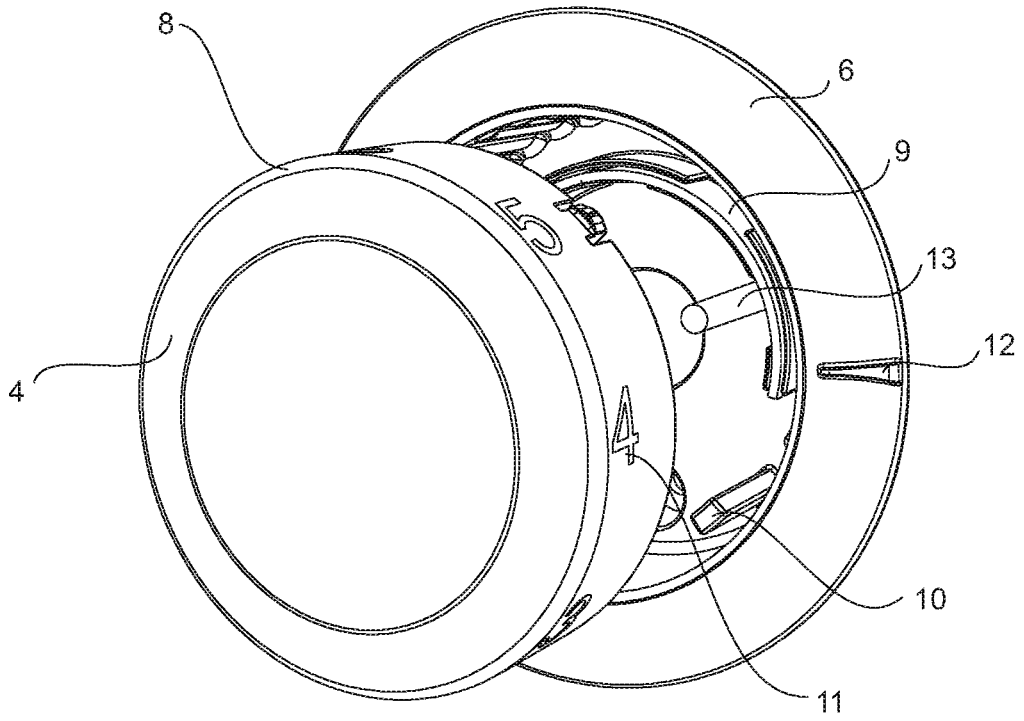

FIG. 3—is the exploded view of a knob and a housing in an embodiment of the present invention.

Figure 4:
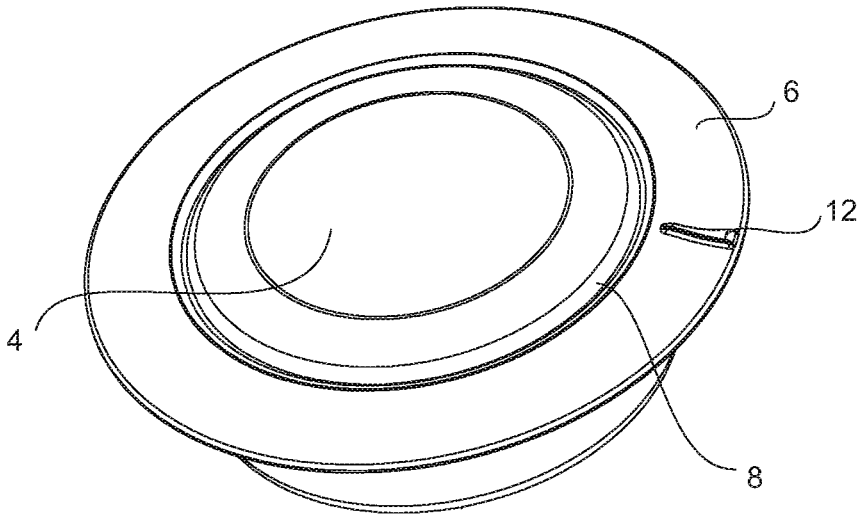

FIG. 4—is the perspective view of a knob and a housing when the knob is in the passive position in an embodiment of the present invention.

Figure 5:
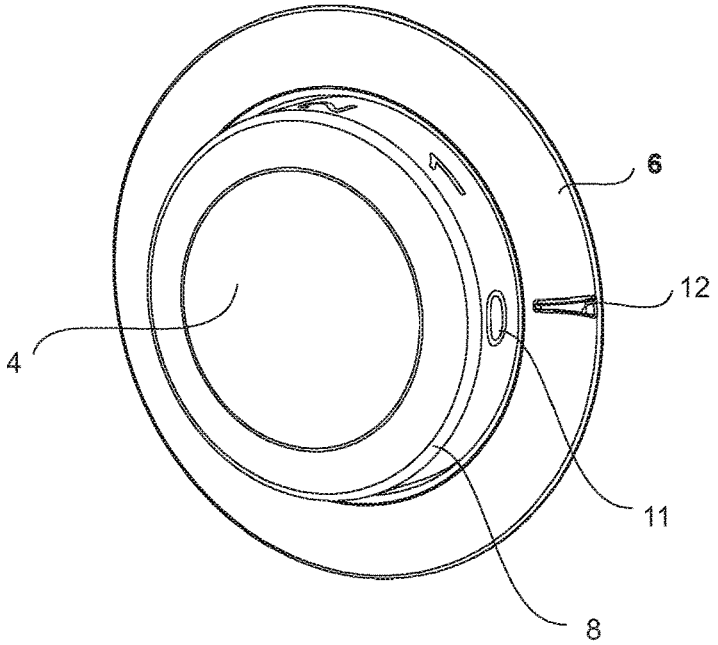

FIG. 5—is the perspective view of a knob and a housing when the knob is in the active position in an embodiment of the present invention.

Figure 6:
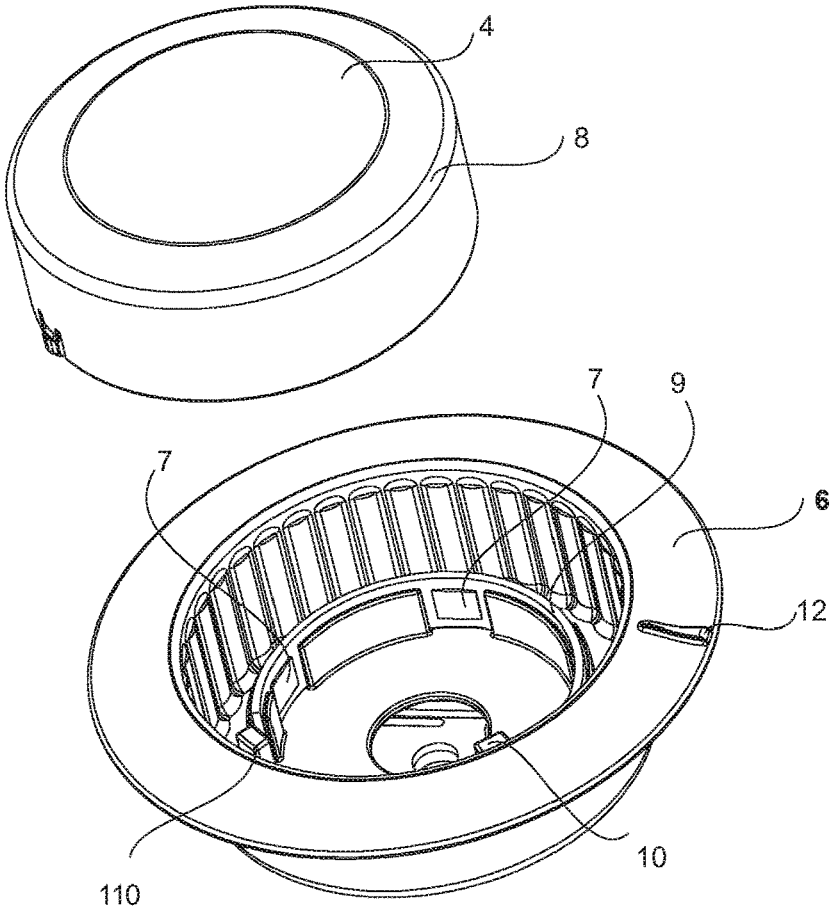

FIG. 6—is the exploded view of a knob and a housing in an embodiment of the present invention.

The elements illustrated in the figures are numbered as follows:

1. Cooling device
2. Compartment
3. Door
4. Knob
5. Opening
6. Housing
7. Light source
8. Illumination aperture
9. Carrier
10. Upright member
11. Temperature value
12. Indicator
13. Light transmitter
14. Switch The cooling device (1) comprises at least one compartment (2, 200) wherein foodstuffs desired to be cooled are placed, at least one door (3) providing access into the compartment (2, 200) and at least one knob (4) that is situated on the surface, facing the inner volume of the compartment (2, 200), of one of the compartment walls and that enables the compartment temperature to be changed by the user.

The cooling device (1) of the present invention comprises the push-release type knob (4) that has an active position wherein the temperature adjustment is performed by rotating the knob (4) and a passive position to which the knob (4) is changed by being pushed when the desired temperature value is set (FIG. 1, FIG. 2).

The user pushes the knob (4) in the passive position and changes the knob (4) to the active position when he/she desires to change the compartment temperature. The user changes the compartment temperature as desired by rotating the knob (4). When the knob (4) is brought to the desired temperature value, the user applies pressure onto the knob (4) and changes the knob (4) back to the passive position.

In an embodiment of the present invention, the cooling device (1) comprises the knob (4) that is, in the passive position, almost coplanar with the compartment wall whereon it is situated. Thus, when foodstuffs are to be placed into the compartment (2, 200), items such as pot, receptacle, etc. are prevented from hitting the knob (4) (FIG. 4).

In an embodiment of the present invention, the cooling device (1) comprises the knob (4) that is connected to the thermostat. In this embodiment, the knob (4) is directly connected to the thermostat. This situation eliminates need for utilizing additional connection members and decreases production costs.

In an embodiment of the present invention, the cooling device (1) comprises an opening (5, 500) arranged on the surface, facing the compartment (2, 200) inner volume, of one of the compartment walls, a housing (6) placed into the opening (5, 500), at least one light source (7) that emits light into the housing (6), a transparent illumination aperture (8) extending along the line where the front and lateral surfaces of the knob (4) intersect and a carrier (9) whereon the light source (7) is placed so as to illuminate the illumination aperture (8) when the knob (4) is placed into the housing (6). The light source (7) is mounted on the carrier (9) before being placed into the housing (6). Afterwards, the knob (4) is placed into the housing (6). When the cooling device (1) is operated, the light source (7) emits light into the housing (6) by being activated. The carrier (9) does not rotate while the knob (4) is being rotated in the housing (6). The light source (7) illuminates the periphery of the knob (4) by means of the illumination aperture (8) and the carrier (9) while the knob (4) is in the housing (6) and is used outside the housing (6) by being rotated (FIG. 6).

In a derivative of this embodiment, the cooling device (1) comprises the circular carrier (9). In this embodiment, the carrier (9) is disposed at the rear side of the circular illumination aperture (8) and is in the same form as the illumination aperture (8).

In another embodiment of the present invention, the cooling device (1) comprises two upright members (10, 110) extending from the base of the housing (6) towards the knob (4) and that limit the movement of the knob (4) in the housing (6) and the partially circular carrier (9) placed between the two upright members (10, 110). The upright members (10, 110) placed into the housing (6) limit the movement of the knob (4) in the housing (6) in both directions. In this embodiment, the carrier (9) is positioned at the level of the arc where the knob (4) moves so as to remain between the two upright members (10, 110). The partially circular carrier (9) is disposed at the rear side of the circular illumination aperture (8) (FIG. 6).

In an embodiment of the present invention, the cooling device (1) comprises more than one transparent temperature value (11) that is disposed around the knob (4) and rotates together with the knob (4) and an indicator (12) disposed on the housing (6), providing the temperature value (11) adjusted by means of the knob (4) to be displayed. The user brings the desired temperature value (11) to the level of the indicator (12) by rotating the knob (4). The temperature values (11) cannot be viewed when the knob (4) is in the passive position (FIG. 4, FIG. 5).

In a derivative of this embodiment, the cooling device (1) comprises a light transmitter (13) extending from the light source (7) towards the illumination aperture (8) so as to provide the temperature value (11) at the level of the indicator (12) to be illuminated. In this embodiment, the light transmitter (13) extends at the level of the indicator (12) and the temperature value (11) remains between the light transmitter (13) and the indicator (12). Not all temperature values (11) around the knob (4) are illuminated (FIG. 3).

In an embodiment of the present invention, the cooling device (1) comprises a switch (14) that enables the light source (7) to be activated when the door (3) is opened. The knob (4), that is in the passive position when the door (3) is opened, illuminates the interior of the compartment (2) by means of the illumination aperture (8).

In an embodiment of the present invention, the cooling device (1) comprises the light source (7) which is a LED light bulb. Thus, illumination process is performed with less energy consumption.

By the knob (4) in the active position being pushed to be changed to the passive position after the temperature adjustment, the knob (4) is prevented from being damaged while loading foodstuffs into the cooling device (1) and unloading foodstuffs from the cooling device (1).

The invention claimed is:

1. A cooling device comprising:

a compartment wherein foodstuff to be cooled are placed;

an opening arranged on a first wall of the compartment facing an inner volume of the compartment;

a housing placed into the opening, the housing containing a light source that emits light into the housing;

a door providing access into the compartment; and a knob that is situated on the first wall of the compartment, facing the inner volume of the compartment, and that enables a temperature (T) of the compartment to be changed, wherein the knob comprises an illumination aperture extending along a periphery of the knob where a front surface and a lateral surface of the knob intersect, wherein the illumination aperture is made of a transparent material, wherein the knob has an active position wherein a temperature adjustment is performed by rotating the knob and has a passive position to which the knob is changed by pushing the knob inward when a temperature value is set;

a carrier within the housing wherein the light source is placed so as to illuminate the illumination aperture when the knob is placed into the housing;

at least two transparent temperature values disposed around the knob, rotating concurrently with the knob;

an indicator disposed on the housing, wherein the indicator indicates at least one of the at least two transparent temperature values as corresponding to the temperature value that is set; and a light transmitter disposed within the housing and extending outward from the light source towards the illumination aperture when the knob is placed into the housing, so as to illuminate the at least one of the at least two transparent temperature values that is indicated by the indicator, and wherein the light transmitter is configured to transmit light from the light source to the at least one of the at least two transparent temperature values that is indicated by the indicator.

2. The cooling device as in claim 1, wherein the knob is connected to a thermostat.

3. The cooling device as in claim 1, wherein the carrier is circular.

4. The cooling device as in claim 1, further comprising: two upright members extending from a base of the housing towards the knob and that limit the a turning movement of the knob in the housing and the carrier is placed between the two upright members.

5. The cooling device as in claim 1, further comprising: a switch that enables the light source to be activated when the door is opened.

6. The cooling device as in claim 1, wherein the light source is a light-emitting diode (LED).

7. The cooling device as in claim 1, wherein the light source illuminates all transparent temperature values from the at least two transparent temperature values.

8. The cooling device as in claim 1, wherein the light transmitter is disposed so as to only illuminate the one of the at least two transparent temperature values that is indicated by the indicator, and wherein remaining temperature values from the at least two transparent temperature values are not illuminated.

9. The cooling device as in claim 1, wherein the light transmitter is coupled to the one of the at least two transparent temperature values when the knob is in the passive position, and wherein the light transmitter is de-coupled from the one of the at least two transparent temperature values when the knob is in the active position.

10. The cooling device as in claim 1, wherein light from the light source passes through the illumination aperture and thereby illuminates the compartment.

* * * * *